US005513896A

United States Patent [19]

Groh et al.

[11] Patent Number: 5,513,896

[45] **Date of Patent: *May 7, 1996**

[54] COVER PIECE FOR SEAT MEMBER OF BLEACHER SEAT UNIT

[75] Inventors: A. Anthony Groh, Columbus, Ohio; Dennis W. Norman, Conroe, Tex.

[73] Assignee: Crane Plastics Company Limited Partnership, Columbus, Ohio

[ * ] Notice: The term of this patent shall not extend beyond the expiration date of Pat. No. 5,368,360.

[21] Appl. No.: 413,187

[22] Filed: Mar. 30, 1995

Related U.S. Application Data

[60] Division of Ser. No. 330,017, Oct. 27, 1994, which is a continuation-in-part of Ser. No. 786,853, Nov. 1, 1991, Pat. No. 5,368,360.

[51] Int. Cl.[6] ..... A47C 27/00

[52] U.S. Cl. ..... 297/219.1; 108/90

[58] Field of Search ..... 108/90; 297/218.1, 297/219.1, 184.11, 184.1, 229.12, 230.12

[56] References Cited

U.S. PATENT DOCUMENTS

| | | | |
|---|---|---|---|
| 2,556,943 | 6/1951 | Reisman | 108/90 |
| 3,173,677 | 3/1965 | Guyot | 108/90 X |
| 3,353,867 | 11/1967 | Anderson | 108/90 X |
| 3,397,011 | 8/1968 | Sklaar . | |
| 4,227,467 | 10/1980 | Kindsfather | 108/90 X |
| 5,070,664 | 12/1991 | Groh et al. . | |
| 5,368,360 | 11/1994 | Groh | 108/90 X |

FOREIGN PATENT DOCUMENTS

| | | | |
|---|---|---|---|
| 642491 | 4/1964 | Belgium | 108/90 |
| 940286 | 12/1948 | France | 108/90 |
| 518273 | 3/1953 | France | 108/90 |
| 475771 | 5/1929 | Germany | 108/90 |
| 894897 | 4/1962 | United Kingdom . | |
| 93014673 | 8/1993 | WIPO | 108/90 |

*Primary Examiner*—Jose V. Chen
*Attorney, Agent, or Firm*—Standley & Gilcrest

[57] ABSTRACT

This is a cover piece for a seat member of a bleacher seat unit. One embodiment is a single resilient polymeric piece adapted to be flexed and placed over a seat member which is provided with a front extension portion to effectively extend the front surface of the seat member. Another embodiment is a cover piece made up of two or more pieces including a top cover portion and at least one second cover piece sufficiently resilient to hold the top cover portion against the seat member.

19 Claims, 4 Drawing Sheets

COVER PIECE FOR SEAT MEMBER OF BLEACHER SEAT UNIT

This is a divisional application of U.S. Patent Application Ser. No. 08/330,017, filed Oct. 27, 1994 which is a continuation-in-part application of U.S. Patent Application Ser. No. 07/786,853, filed Nov. 1, 1991, now U.S. Pat. No. 5,368,360, entitled Cover Piece for Seat Member of Bleacher Seat Unit by A. Anthony Groh.

BACKGROUND

The present invention relates to a cover piece for the seat member of a bleacher seat unit. Such cover pieces can be used on outdoor or indoor bleacher seat units such as those found in gymnasiums, sports arenas and fields, outdoor and indoor swimming pools and similar spectator facilities. The invention can also be used on telescoping bleacher seat units such as those normally found in indoor settings.

Although many of the more modern bleacher seat units are made with plastic seat members, wood has been and continues to be used in the construction of bleacher seat units, including the seat member portion. Because the seat portions of the units must be long and straight, kit is necessary to use selected cuts of wood, such as dense, tough Southern Pine. Also, for increased longevity and durability, the wood must be treated to resist scratching, scuffing and staining. From the standpoint of appearance, original manufacturers generally prefer cuts of wood which do not contain unattractive artifacts, such as knotholes, unsightly grain lines, etc. This causes manufacturers to reject otherwise structurally suitable cuts of wood, with rejection rates commonly reaching as high as thirty percent.

Because bleacher seat units are generally prepared as complete assemblies, it is often difficult and expensive to replace individual seat portions as they become worn through normal use, or abuse.

More modern bleacher seat units that use specially manufactured plastic seat portions are commercially available. However, it is not economically feasible to retrofit the all wooden units with the more durable plastic seating.

Accordingly, it is desirable to provide the benefits of cover pieces to seat portions of bleacher seat units which presently use wooden seat portions, whether at the point of original manufacture or as a retrofit item. These benefits include greater durability, greater stain and marring resistance, and greater slip resistance, with reduced danger from splintering or cracking. Another benefit to the original manufacturer is that wood cuts that would ordinarily be rejected as unattractive can be used. Likewise, it is also deskable to be able to use other building materials in bleacher seats which otherwise would be unacceptable. One example of such a material is aluminum which in sheet form is vex uncomfortable for seating.

Another problem posed by many telescoping bleacher seat units is that their complex construction makes them difficult to retrofit with plastic overlays. This is particularly true in bleacher seat assemblies that have facing, vertical kick panels which are attached so as to reside in close proximity to and descending from the front edge of the seat portion members. It is therefore difficult to provide a plastic sheathing for the seat portion which will completely clad the wood seat member in situ. Accordingly, it is desirable to produce a plastic seat cover which will allow one to cover the seat portion of a bleacher seat unit without requiring special tools or disassembly of the seat portions from the bleacher seat unit.

The foregoing objectives and advantages are provided by the present invention. Other advantages and the solutions to other problems may become apparent to one of ordinary skill in light of the present disclosure.

SUMMARY OF THE INVENTION

Toward achieving the above objectives and advantages, the present invention relates to a cover piece for the seat portion of a bleacher seat unit, and to a bleacher seat unit having a plurality of seat members having at least one of its seat members provided with a cover piece of the present invention. In its most general form, the cover piece comprises a polymeric material, such as a polymeric extrudate, which extends longitudinally and laterally to cover the top of the seat member. The cover piece of the present invention also has side portions of the seat member and/or to grasp at least a portion of the underside of the seat member. The principal functions of the present invention are to provide a comfortable, protective covering to the seat member and to have the cover piece resist sliding from its position on the seat member without the need for additional affixation means (such as bolts, nails, screws, etc.).

The cover piece of the present invention can be most described as a resilient polymeric member, having an original shape, and comprising a substantially flat top portion adapted to be substantially coextensive with said top surface of said seat member, and two lip portions appended to said top portion; wherein said polymeric member is sufficiently resilient so that it may be flexed from said original shape to a tensed shape wherein said lip portions engage said two side surfaces and said bottom surface. The present invention in its broadest form is not limited to any particular geometry of the lip portions, which may comprise any arrangement of straight and/or curved sections so long as they perform the function of the present invention.

As one example of such a geometry, the cover piece, in its original shape, is made to appear, in cross section to approximate a figure which can be colloquially described as that of a closed staple, as will be more precisely defined and shown in the figures herein.

The polymeric material used in this example of the cover piece of the present invention, and its thickness, are selected to provide the cover piece with a sufficient amount of resilience so that the cover piece can be moved from its original shape to a tensed shape wherein it assumes a substantially rectangular configuration (that is, the angels between its individual portion segments become approximately 90 degrees). This allows the cover piece to be placed over the seat member, and the resilience of the cover piece causes static forces to be applied to the side surfaces and underside surfaces of the seat member, to hold the cover piece in place.

The cover piece may be made to fit closely about any size seat member.

The polymeric material which may be used in the present invention can be selected from the group consisting of thermoplastic materials such as polyvinylchlorides, polyethylenes, ABS plastics, and styrenes; with appropriate strength and resilience characteristics. In this regard, it is most preferred that the plastic chosen in part a sufficient amount of resilience to the cover piece to allow the cover piece to be relatively easily flexed to fit over the seat member, and with sufficient resilience that, once placed over the seat member, the cover piece, by attempting to return to its original form, imparts a static force against the sides and/or the under side of the seat member to hold the cover piece in place.

As will be more fully described below, in a preferred embodiment, the cover piece of the present invention comprises a top portion which is dimensioned to be coextensive with the top portion of the seat member to be covered. Descending from the top portion on either side are side portions which are at an angle less than 90 degrees to the top portion. The side portions are dimensioned to be coextensive with the sides of the seat member. Extending from the side portions are lip portions which are disposed at an angle of less than 90 to their respective side portion. It is preferred that the aforementioned angles of less than 90 degrees be in the range of from about 75 to about 89 degrees, and such angle will vary depending on the degree of stiffness and resilience of the polymeric material utilized. Typically, the dimensions for the top, side and lip portions are 9.5 inches, 1.00 inches and 0.75 inches, respectively.

Any portions of the cover piece which will be exposed during its use (generally the top and side portions) may be textured or embossed to improve its appearance and/or comfort in seating, such as to provide slide resistance.

For making a bleacher seat and cover which may feature an extended front side surface (i.e. that surface behind the knees when sitting), the invention may also include a cover piece and seat member for a bleacher seat unit comprising: (a) a seat member having a top surface, a bottom surface having a front half and a rear half, and a front side surface and a rear side surface; (b) an extension member extending from the front half of the bottom surface so as to provide an extension of the front side surface; and (c) a cover piece comprising a resilient member comprising a polymeric material, the member having an original shape, the member comprising: (i) a substantially flat top portion adapted to be substantially coextensive with the top surface of the seat member, and (ii) a rear lip portion and a front lip portion, the front lip portion having a terminal end adapted to engage the extension member. The cover member is sufficiently resilient so that it may be flexed from the original shape to a tensed shape whereby the cover member can be placed over the seat member whereby the rear lip portion extends over the rear side surface and the front lip portion extends over the front side surface and the extension portion such that the terminal end of the front lip portion engages the extension member; and whereby, once released from the tensed shape so as to form a relatively less tensed shape, the rear lip portion exerts a static force on a surface selected from the group consisting of the rear side surface and the bottom surface. It is preferred that once the cover piece is released from the tensed shape so as to form a relatively less tensed shape, the front lip portion exerts a static force on the extension portion. It is also preferred that the front lip portion is shaped so as to maintain a space between the front side surface and the front lip portion, to provide a comfortable, resilient surface against which to rest the ventral portion of the knees when seated.

Another embodiment of the present invention allows a bleacher seat/cover piece to be constructed from a number of polymeric pieces. This embodiment of the invention is a cover piece and seat member for a bleacher seat unit, the cover piece and seat member comprising: (a) a seat member having a top surface, a bottom surface, a front side, a rear side and two terminal end side; (b) a cover piece comprising: (i) a first cover piece portion comprising a polymeric material having a substantially flat top portion and adapted to be substantially coextensive with the top surface of the seat member; and (ii) at least one second cover piece portion comprising a resilient polymeric material, the member having an original shape and comprising a side portion, a top lip portion and a bottom lip portion; wherein the at least one second cover member is sufficiently resilient so that it may be flexed from the original shape to a tensed shape whereby the at least one second cover member can be placed over at least one of the sides of the seat member whereby once released from the tensed shape so as to form a relatively less tensed shape, the top lip portion and the bottom lip portion cooperate to urge the first cover piece portion against the top surface of the seat member.

It is preferred that the first cover piece portion comprises a side portion adapted to extend over at least a portion of the front side of the seat member. It is also preferred that the first cover piece portion comprises a side portion adapted to extend over at least a portion of the rear side of the seat member. The first cover piece portion therefore may have two side portions adapted to extend over at least a portion of, respectively, the front and rear sides of the seat member.

The front side and/or rear side of the seat member may be provided with a second cover piece portion as described above. It is preferred that both the front side of the seat member and the rear side of the seat member are provided with a second cover piece portion. The cover piece preferably is an extrudate of a thermoplastic polymeric material selected from the group consisting of polyvinylchlorides, polyethylenes, ABS plastics and styrenes. The first cover piece portion and the second cover piece portion(s) typically will have a thickness in the range of from about 1 millimeters to about 10 millimeters, although greater or lesser thicknesses may be used. In the preferred embodiment, the cover piece is an extrudate of a polymeric material and the first cover piece portion and the one second cover piece portion(s) have a thickness in the range of from about 1 millimeters to about 3 millimeters when the polymeric material is polyvinylchloride.

The second cover piece(s) may have a cross-section having an arcuate portion when in its said relatively less tensed shape.

The second cover piece may also be shaped such that its original shape, in cross-section, defines an approximate figure comprising: (a) a substantially straight first line segment having two first end points; (b) a second line segment extending from one of said first end points at first angle of 90 degrees or less; and (c) a third line segment extending from the other of said first end points at a second angle of less than 90 degrees. It is preferred that the first angle is in the range of from about 90 degrees to about 70 degrees, and that the second angle is in the range of from about 89 degrees to about 70 degrees. It is also preferred that the portion of second cover piece(s) corresponding to the second line segment is tapered in decreasing thickness as it extends away from the corresponding first end point(s) from which it/they extend, and that the second cover piece corresponding to the third line segment is tapered in decreasing thickness as it extends away from the first end point(s) from which it/they extend. Finally, it is also preferred that the first angle is less than about 90 degrees when the second cover piece(s) is/are in its/their original shape, and that the first angle becomes about 90 degrees when the second cover piece(s) is/are in its/their relatively less tensed shape. Likewise, it is preferred that the second angle is less than about 90 degrees when the second cover piece(s) is/are in its/their original shape, and that the second angle(s) become(s) about 90 degrees when the second cover piece(s) is/are in its/their relatively less tensed shape.

In the most preferred embodiment, at least one of the terminal end sides of the seat member is provided with a second cover piece portion.

DETAIL DESCRIPTION OF THE PREFERRED EMBODIMENT

In accordance with the foregoing summary of the invention, the following presents a preferred embodiment of the invention which is presently considered to be the best mode of the invention.

Figure 1:
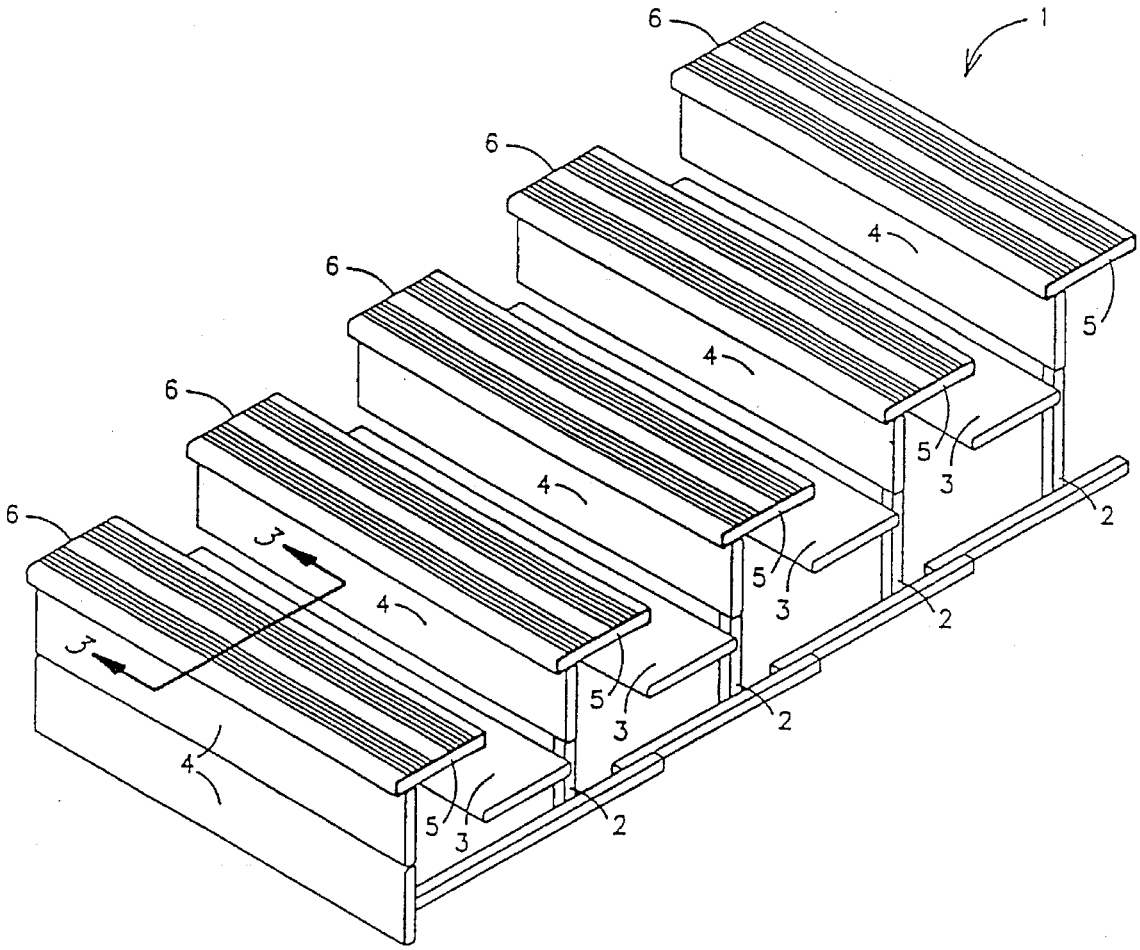
FIG. 1 is a sectioned environmental view of a telescoping bleacher seat unit in its extended configuration, and showing the cover piece of the present invention in use.

Turning first to FIG. 1, this figure shows an environmental view of a telescoping bleacher seat unit 1 in its extended configuration as it would be placed for seating. The bleacher seat unit 1 comprises frame work pieces 2 (generally made of metal), foot rest pieces 3 and kick panel pieces 4. Also shown are seat members 5 which are shown covered with the cover piece 6 of the present invention.

Figure 2:
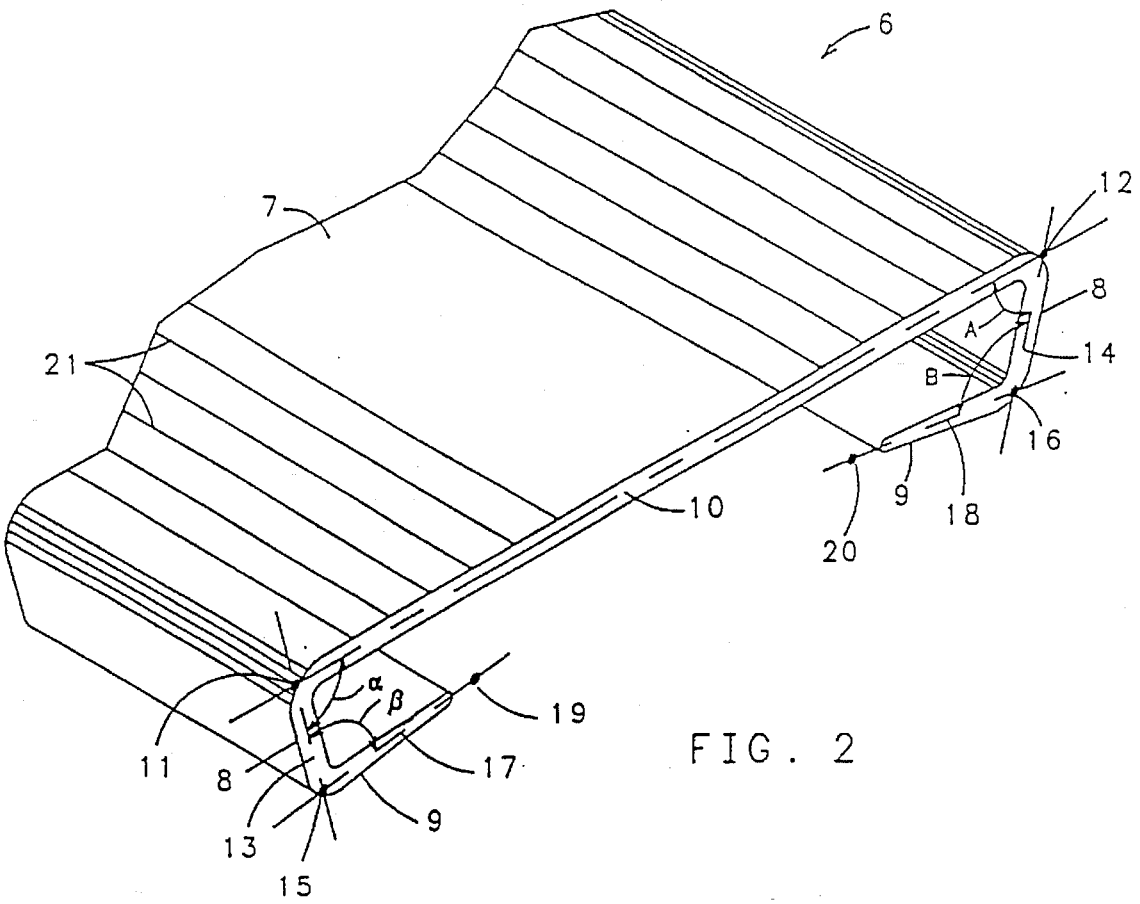
FIG. 2 is a sectioned, angles perspective view showing a section of a cover piece in accordance with one embodiment of the present invention.

FIG. 2 is a sectioned, angled perspective view of a section of a cover piece 6 in accordance with embodiment of the present invention. Cover piece 6 can be generally described as having top portion 7, side portions 8, each of side portions 8 descending from the top portion 7 at a first angle alpha which is less than 90 degrees. Each side portion 8 has respectively a lip portion 9 which extends inwardly at an angle delta, less than 90 degrees.

The shape of the cover piece of the present invention defines, in cross-section, approximately a figure comprising: (a) a substantially straight line segment 10 having two first end-points 11 and 12; (b) a second line segment extending from each of said to end points (segment 13 extending from end point 11 and segment 14 extending from end point 12 at a first angle alpha of less than 90 degrees to the first line segment 10, the second line segments 13 and 14 having two end points 15 and 16, respectively; and (c) a third line segment extending from each of said second end points of said second line segments to a third point (i.e., third line segment 17 extending to end point 19 and third line segment 18 extending to endpoint 20), at a second angle beta less than 90 degrees to said respective second line segments (i.e., segments 13 and 14 respectively).

In the embodiment of the present invention shown in FIG. 2, angle alpha is approximately 75 degrees, and angle beta is approximately 80 degrees.

Figure 3:
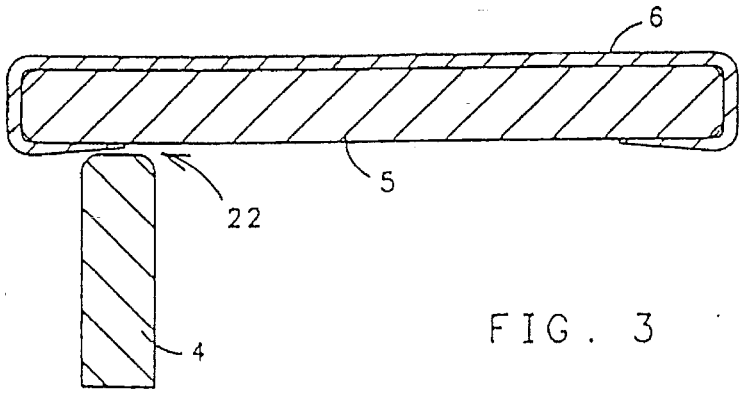
FIG. 3 is a section of view along line 3—3 showing a cover piece in accordance with one embodiment of the present invention covering a seat member of a bleacher seat unit.

In the preferred embodiment of the present invention, it is preferred that the thickness of the third line segments 17 and 18 be tapered downward in thickness from points 15–19 and points 16–20, respectively, This allows the cover piece to be easily slipped into position over the seat member as shown in FIG. 3.

In an alternative embodiment, the portions corresponding to the second and third line segments may be replaced with a continuous curved portion which likewise is adapted to engage and grasp the side and bottom portions of the seat member.

The exposed portions of top portion 7 and side portion 8 may preferably be embossed or textured to provide a more attractive appearance and or to provide more comfortable seating. This is shown for instance as ribbing 21.

FIG. 3 is a cross-section view along line 3—3 of FIG. 1. This figure shows cover piece 6 in position over seat member 5, and shows the normally close spacing between seat member 5 and kick panel piece 4.

As can be seen in FIG. 3, the cover piece of the present invention is made of a polymeric material of sufficient thickness so as to be sufficiently flexibly resilient to allow cover piece 6 to be moved from its original shape (shown in FIG. 2) to a substantially more rectangular shape as can be seen in FIG. 3. In this second or "tensed" shape, the cover piece of the present invention has been deformed so that the side portions 8 and lip portions 9 have been flexed to a position such that angles alpha and beta are approximately 90 degrees to fit over the seat member 5. The stiff resilience of the polymeric material is such that the cover piece, in attempting to return to its original shape, in imparts static forces against the side of the seat member 5, by virtue of lip portions 8 pushing inwardly substantially perpendicular to their inner faces (i.e. substantially perpendicular to the position line segments 13 and 14 would assume when angle alpha become 90 degrees). In like fashion, lip portions 9 pushes upwardly against the underside of seat member 5 (i.e. substantially perpendicular to the position line segments 17 and 18 would assume when angle beta becomes approximately 90 degrees).

FIG. 3 also shows that the tapering of lip portions 9 aid in allowing cover piece 6 to be positioned over seat member 5, notwithstanding the close proximity of kick panel piece 4. The tapering of lip portions 5, notwithstanding the close proximity of kick panel piece 4. The tapering of lip portions 9 allow them to be more easily positioned between seat member 5 and kick panel piece 4 in gap 22.

It is preferred that the cover piece of the present invention be formed as a polymeric extrudate, as this is thought to be the most efficient way to produce the desired shape. In the embodiment shown here, the thickness of the top portion 7 and the side portions 8 are preferably about two millimeters and the lip portion tapered in thickness from two millimeters to less than one millimeter, when the polymeric material used in polyvinylchloride.

It will be noted that the top, side and lip portions shown in FIG. 2 are actually joined at rounded junctions rather than sharp corners. It is preferred that the junctions be rounded to improve the comfort of the resulting covered seat member shown in FIG. 3, as well as to improve its strength characteristics and ease of manufacturer. It should therefore be understood that this embodiment of the present invention is not limited by any shape or configuration beyond the general geometric description given above.

It is preferred that the cover piece of the present invention be prepared as the extrudate of a thermoplastic material. Such an extrudate may be made using extruder machines and apparatus commonly known and used in the plastics art such as Models CM-65, CM-80 or CM-111, commercially available from Cincinnati Milacron of Cincinnati, Ohio; Model GC-8, commercially available from David Standard Company, or equivalent apparatus.

Figure 4:
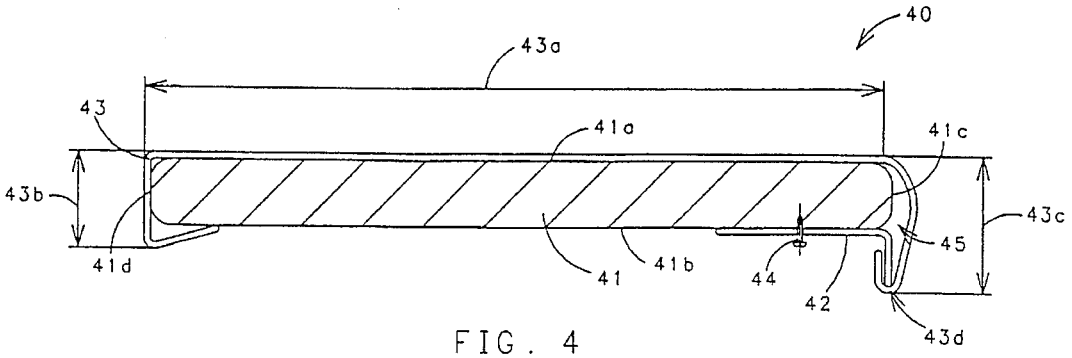
FIG. 4 is a cross-sectional view of a bleacher seat and cover piece according to another embodiment of the present invention.

FIG. 4 shows another embodiment which is a variation of the present invention.

FIG. 4 shows bleacher seat and cover piece combination 40 which comprises bleacher seat member 41 which has top surface 41*a*, a bottom surface 41*b* having a front half (to the right) and a rear half(to the left), a front side surface 41*c* and a rear side surface 41*d*.

FIG. 4 also shows an extension member 42 (affixed such as by nail, screw or bolt 44, or by other equivalent means such as an adhesive) extending from said front half of said bottom surface 41*b* so as to provide an extension of said front side surface 41*c*. Extension member 42 may be, for instance, a longitudinally-extending roll-formed metal strip or a plastic extrudate, or may be a number of intermittently-spaced structures along the length of the seat member.

FIG. 4 shows a cover piece 43 comprising a resilient member of a polymeric material, which was placed over seat member by deforming it from its original shape. The cover piece comprises: (a) a substantially flat top portion 43*a* adapted to be substantially coextensive with said top surface 41*a* of the seat member 41, and a rear lip portion 43*b* and a front lip portion 43*c*, the front lip portion having a terminal end 43*d* adapted to engage said extension member 42. The cover piece 43 is sufficiently resilient so that it may be flexed from its original shape to a tensed shape whereby the cover piece 43 can be placed over the seat member whereby the rear lip portion 43*b* extends over the rear side surface 41*d* and the front lip portion 43*c* extends over both the front side surface 41*c* and the extension portion 42 such that the terminal end 43*d* of the front lip portion 43*c* engages the extension member 42; and whereby, once released from the tensed shape so as to form a relatively less tensed shape, the rear lip portion 43*b* exerts a static force the rear side surface 41*d* and the bottom surface 41*b*, or both, to hold the cover piece in place. It is preferred that, once the cover piece 43 is released from its tensed shape so as to form a relatively less tensed shape, the front lip portion 43*c* exerts a static force on the extension portion 42, to hold the cover piece in place.

Preferably, once the cover piece 43 is released from its tensed shape so as to form a relatively less tensed shape, the front lip portion 43*c* is shaped so as to maintain a space 45 between the front side surface 41*c* and the front lip portion 43*c*. This renders the cover piece relatively flexible to the dorsal knee area of the seated user.

It is preferred that the cover piece have an original shape such that, once left in is relatively less tensed shape over the seat member, the side of rear lip portion 43*b* is at a right angle with the top portion 43*a* (see angle $\alpha$ in FIG. 4).

Figure 5:
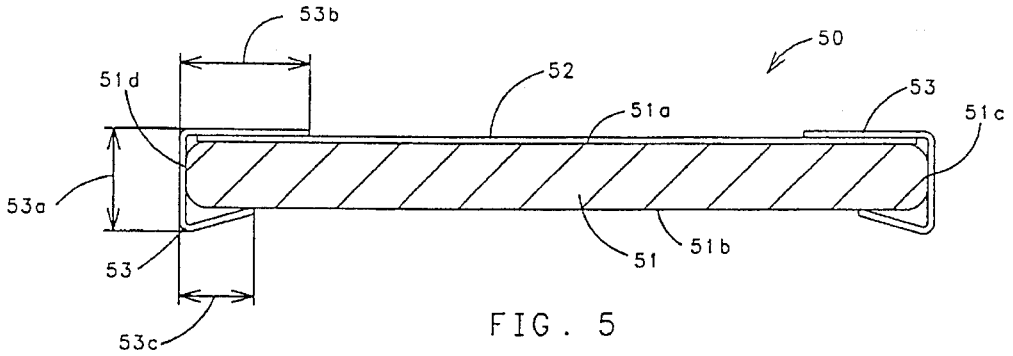
FIG. 5 is a cross-sectional view of a bleacher seat and cover piece according to another embodiment of the present invention.
Figure 6:
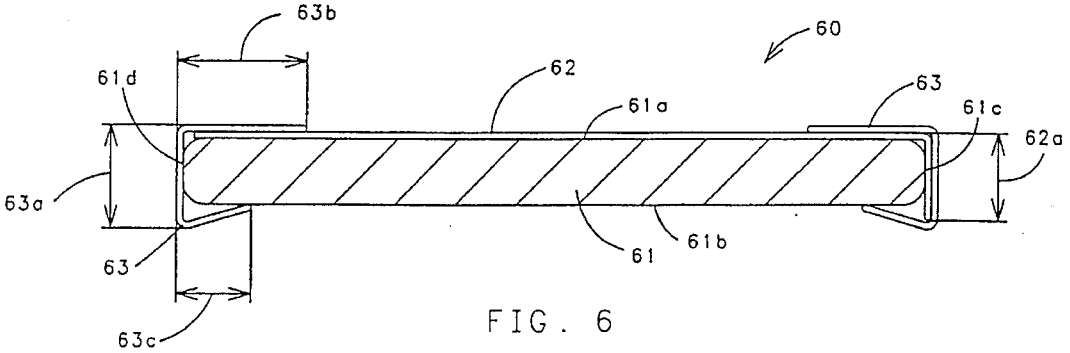
FIG. 6 is a cross-sectional view of a bleacher seat and cover piece according to yet another embodiment of the present invention.
Figure 7:
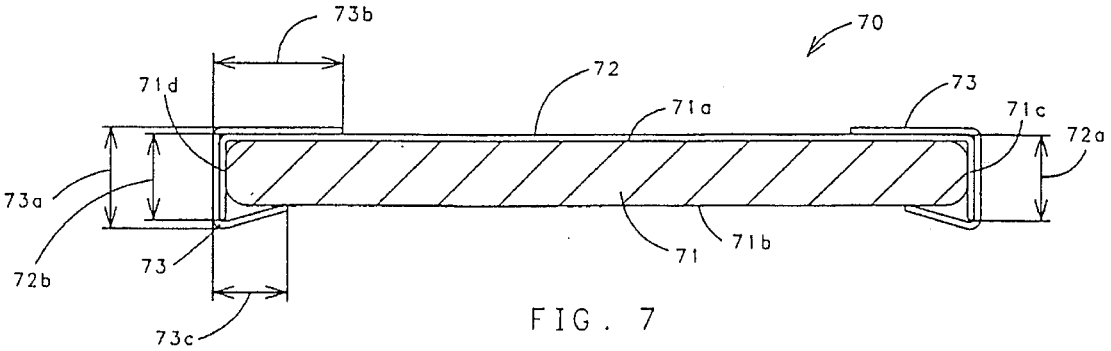
FIG. 7 is a cross-sectional view of a bleacher seat and cover piece according to yet another embodiment of the present invention.

Still another embodiment type of the present invention is shown in FIGS. 5–7.

FIG. 5 shows bleacher seat and cover piece combination 50 which comprises bleacher seat member 51 which has top surface 51*a*, a bottom surface 51*b* having a front half(to the right) and a rear half(to the left), a front side surface 51*c* and a rear side surface 51*d*.

FIG. 5 shows a cover piece comprising: (a) a first cover piece portion 52 comprising a polymeric material having a substantially flat top portion and adapted to be substantially coextensive with said top surface of said seat member; and (b) at least one second cover piece portion 53 comprising a resilient polymeric material and which was placed over the side(s) of seat member 51*c* or 51*d* by deforming it from its original shape. The second cover piece portion(s) have a side portion 53*a*, a top lip portion 53*b* and a bottom lip portion 53*c*. The second cover piece portion(s) is/are sufficiently resilient so that it/they may be flexed from its/their original shape to a tensed shape whereby it/they can be placed over one or both of the sides of said seat member whereby, once released from its/their tensed shape so as to form a relatively less tensed shape, top lip portion(s) and the bottom lip portion(s) cooperate to urge the first cover piece portion 52 against said top surface 51*a* of the seat member 51.

FIG. 6 shows another embodiment of the present invention where elements 60–63*d* correspond to elements 50–53*d* in FIG. 5. In FIG. 6 however, the first cover piece portion 62 comprises a side portion 62*a* adapted to extend over at least a portion of the front side surface 61*c* of said seat member 61. This construction lends more stability to the arrangement. It will be understood that this arrangement may be reversed to place the side portion 62*a* over at least a portion of the rear side surface 61*d* of said seat member 61.

FIG. 7 shows another embodiment of the present invention where elements 70–73*d* correspond to elements 50–53*d* in FIG. 5. In FIG. 7 however, the first cover piece portion 72 comprises a side portion 72*a* and 72*b* adapted, respectively to extend over at least a portion of both the front side surface 71*c* and the rear side surface 71*d* of said seat member 71. This construction lends more stability to the arrangement.

As can be appreciated from the embodiments shown in FIGS. 5–7, either or both the front and rear side of the seat member may be provided with a second cover piece portion as described above. The use of a second cover piece portion on both the front and rear side of the seat member is preferred.

As a most preferred embodiment, the terminal ends of the seat member may also be provided with a second cover piece portion as described above to improve the appearance of the bleacher seat and to best prevent snagging of clothing and slippage of the other cover portions along the longitudinal axis of the seat member. See FIG. 9.

The second cover piece portion may, alternatively have a cross-section having an arcuate portion when in its said relatively less tensed shape.

The cover piece may be an extrudate of a thermoplastic polymeric material selected from the group consisting of polyvinylchlorides, polyethylenes, ABS plastics and styrenes.

The first cover piece portion and the second cover piece portion(s) typically will have a thickness in the range of from about 1 millimeters to about 10 millimeters, although other thicknesses may be used depending upon the flexibility of the material. For instance, the first cover piece portion and the second cover piece portion(s) may have a thickness in the range of from about 1 millimeters to about 3 millimeters when said polymeric material is polyvinylchloride.

Figure 8:
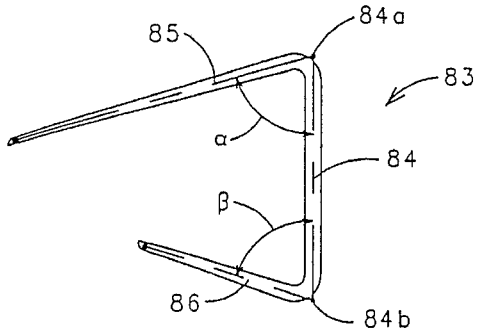
FIG. 8 is a cross-sectional view of a portion of the cover piece which may be used in accordance with some of the embodiments of the present invention, such as those shown in FIGS. 5, 6, and 7.

As seen in FIG. 8, the second piece portion 83 which may be used in accordance with the present invention for items 53, 63 and 73 in FIGS. 6, 7 and 8 respectively, may have an original shape which, in cross-section, defines an approximate figure comprising: (a) a substantially straight first line segment 84 having two first end points 84*a* and 84*b;* (b) a second line segment 85 extending from one of said first end points (i.e. 84*a*) at first angle β of 90 degrees or less; and (c) a third line segment 86 extending from the other of said first end points (i.e. 84*b*) at a second angle β of less than 90 degrees. Preferably angle α is in the range of from about 90 degrees to about 70 degrees and angle β is in the range of from about 89 degrees to about 70 degrees.

As can be seen in FIG. 8, the portion of the one second cover piece corresponding to said second line segment 85 is tapered in decreasing thickness as it extends away from first end point (i.e. 84*a*). Likewise, the portion of said at least one second cover piece corresponding to said third line segment 86 is tapered in decreasing thickness as it extends away from the other first end point (i.e. 84*b*).

It is also preferred that first angle α is less than about 90 degrees when the second cover piece is in its original shape, and wherein said first angle α becomes about 90 degrees when the second cover piece is in its relatively less tensed shape after being placed over the side of the seat member. Likewise, it is preferred the second angle β is less than about 90 degrees when the second cover piece is in its original shape, and wherein said second β angle becomes about 90 degrees when the second cover piece is in its relatively less tensed shape after being placed over the side of the seat member.

Figure 9:
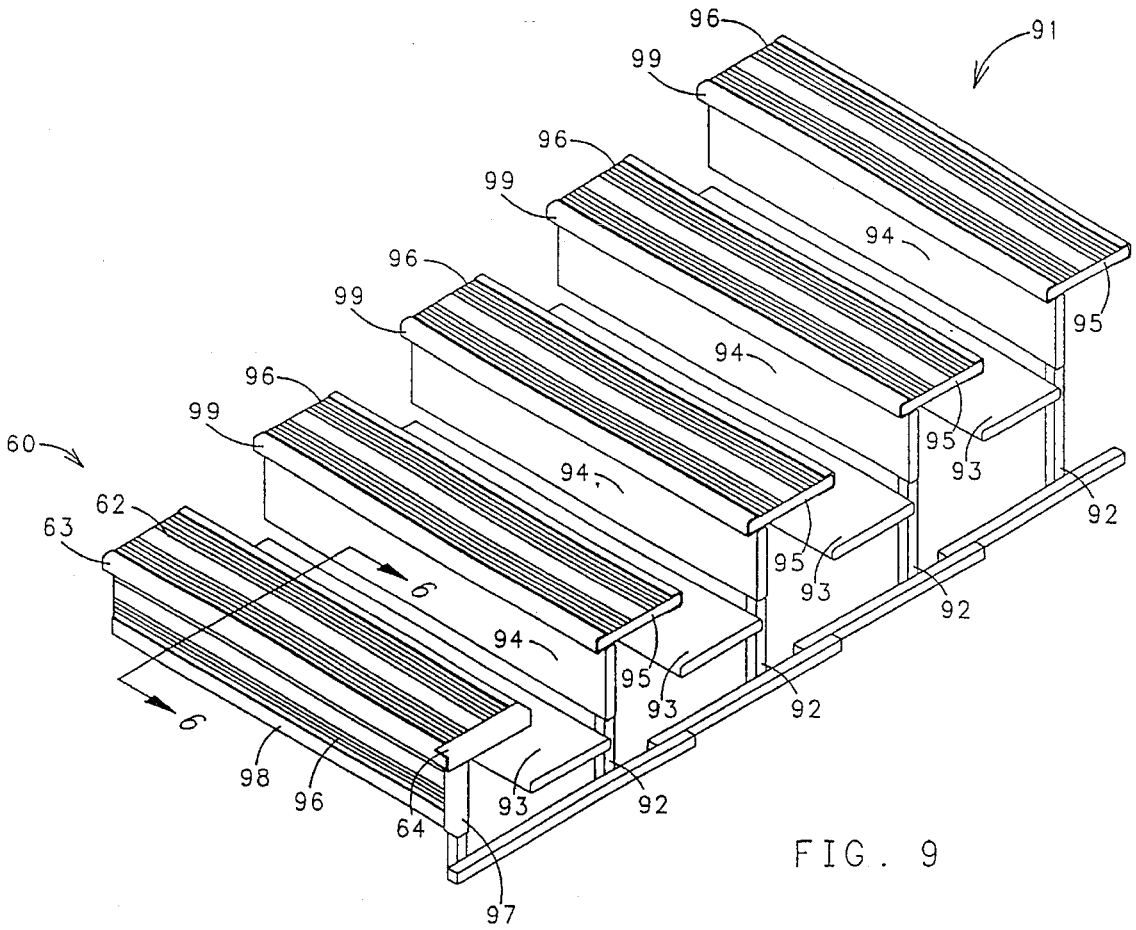
FIG. 9 is a perspective view of a bleacher seat unit having a bleacher seat and cover piece according to one the present invention, such as the embodiment shown in FIG. 6.

FIG. 9 is a perspective view of a bleacher seat 91 unit, constructed of frame 92 (which may be of the collapsible or non-collapsible variety in accordance with constructions known in the art). Bleacher seat unit 91 has bleacher seats 95, foot rests 93 and facia pieces 94. The seat members 95 are shown as having a cover piece in accordance with any of the embodiments of the present invention, such as those shown in FIGS. 5, 6 or 7. FIG. 9 also shows the use of a cover piece on the lowermost seat member forming bleacher seat/cover piece combination 60 in accordance with the embodiment shown in FIG. 6. FIG. 9 shows the lowermost seat member bearing first cover piece portion 62 and second cover piece portion 63. Also shown is section line 6—6 which shows the perspective of FIG. 6 itself. Also visible in FIG. 9 is terminal cover piece portion 64 (not seen in FIG. 6), which may have the same cross-sectional architecture as described in and with respect to FIG. 8 herein. The terminal cover piece portion 64 secures and finishes the ends of the bleacher seat member. FIG. 9 also shows the application of the cover piece in accordance with the present invention to a facia piece, such as that below the lowermost seat member. FIG. 9 shows that facia piece having first cover piece portion 96, second cover piece portion 98 and terminal cover piece portion 97. In like fashion, if desired, a cover piece in accordance with the present invention may even be applied to the foot rest portions, such as foot rests 93 in the same way as in shown with respect to the bleacher seats and facia pieces. Accordingly, as used herein, it is understood that the term "bleacher seat member" shall include bleacher seats, foot rests and/or various other facia pieces of a bleacher seat unit.

In view of the foregoing disclosure, it will be obvious to one of ordinary skill in the art to make modifications or alteration, or to substitute equivalents, to or in the present invention without affective the function, manner of function, or result or the present invention. Such modifications may include, for instance, the use of alternative geometries, alternative materials, etc.

What is claimed is:

1. A cover piece and seat member for a bleacher seat unit, said cover piece and seat member comprising:

a. a seat member having a top surface, a bottom surface, a front side, a rear side and two terminal end sides;

b. a cover piece comprising:

i. a first cover piece portion comprising a polymeric material and having a substantially flat top portion and adapted to be substantially coextensive with said top surface of said seat member; and ii. at least one second cover piece portion comprising a resilient polymeric material, said at least one second cover piece portion having an original shape and comprising a side portion, a top lip portion and a bottom lip portion;

wherein said at least one second cover piece portion is sufficiently resilient so that it may be flexed from said original shape to a tensed shape whereby said at least one second cover piece portion can be placed over at least one of said sides of said seat member whereby, once released from said tensed shape so as to form a relatively less tensed shape, said top lip portion and said bottom lip portion cooperate to urge said first cover piece portion against said top surface of said seat member.

2. A cover piece and seat member according to claim 1 wherein first cover piece portion comprises a side portion adapted to extend over at least a portion of said front side of said seat member.

3. A cover piece and seat member according to claim 1 wherein first cover piece portion comprises a side portion adapted to extend over at least a portion of said rear side of said seat member.

4. A cover piece and seat member according to claim 1 wherein first cover piece portion comprises two side portions adapted to extend over at least a portion of, respectively, said front and rear sides of said seat member.

5. A cover piece and seat member according to claim 1 wherein said front side of said seat member is provided with a second cover piece portion.

6. A cover piece and seat member according to claim 1 wherein said rear side of said seat member is provided with a second cover piece portion.

7. A cover piece and seat member according to claim 1 wherein said front side of said seat member and said rear side of said seat member are provided with a second cover piece portion.

8. A cover piece and seat member according to claim 1 wherein at least one of said terminal end sides of said seat member is provided with a second cover piece portion.

9. A cover piece and seat member according to claim 1 wherein said at least one second cover piece has a cross-section having an arcuate portion when in its said relatively less tensed shape.

10. A cover piece and seat member according to claim 1 wherein said cover piece is an extrudate of a thermoplastic polymeric material selected from the group consisting of polyvinylchlorides, polyethylenes, ABS plastics and styrenes.

11. A cover piece and seat member according to claim 1 wherein said first cover piece portion and said at least one second cover piece portion have a thickness in the range of from about 1 millimeters to about 10 millimeters.

12. A cover piece and seat member according to claim 1 wherein said cover piece is an extrudate of a polymeric material and wherein said first cover piece portion and said at least one second cover piece portion have a thickness in the range of from about 1 millimeters to about 3 millimeters when said polymeric material is polyvinylchloride.

13. A cover piece and seat member according to claim 1 wherein said at least one second cover piece has an original shape which, in cross-section, defines an approximate figure comprising:

a. a substantially straight first line segment having two first end points;

b. a second line segment extending from one of said first end points at first angle of 90 degrees or less; and c. a third line segment extending from the other of said first end points at a second angle of less than 90 degrees.

14. A cover piece and seat member according to claim 13 wherein said first angle is in the range of from about 90 degrees to about 70 degrees.

15. A cover piece and seat member according to claim 13 wherein said second angle is in the range of from about 89 degrees to about 70 degrees.

16. A cover piece and seat member according to claim 13 wherein the portion of said at least one second cover piece corresponding to said second line segment is tapered in decreasing thickness as it extends away from said one of said first end points.

17. A cover piece and seat member according to claim 13 wherein the portion of said at least one second cover piece corresponding to said third line segment is tapered in decreasing thickness as it extends away from said other of said first end points.

18. A cover piece and seat member according to claim 13 wherein said first angle is less than about 90 degrees when said at least one second cover piece is in said original shape, and wherein said first angle becomes about 90 degrees when said at least one second cover piece is in said relatively less tensed shape.

19. A cover piece and seat member according to claim 13 wherein said second angle is less than about 90 degrees when said at least one second cover piece is in said original shape, and wherein said second angle becomes about 90 degrees when said at least one second cover piece is in said relatively less tensed shape.

* * * * *